US012715680B2

(12) United States Patent
Gordon

(10) Patent No.: US 12,715,680 B2
(45) Date of Patent: Aug. 25, 2026

(54) PICKLE CONTAINER

(71) Applicant: Patricia Gordon, Memphis, TN (US)

(72) Inventor: Patricia Gordon, Memphis, TN (US)

( * ) Notice: Subject to any disclaimer, the term of this patent is extended or adjusted under 35 U.S.C. 154(b) by 0 days.

(21) Appl. No.: 18/180,798

(22) Filed: Mar. 8, 2023

(65) Prior Publication Data

US 2023/0286730 A1 Sep. 14, 2023

Related U.S. Application Data

(60) Provisional application No. 63/317,817, filed on Mar. 8, 2022.

(51) Int. Cl.
*B65D 85/00* (2006.01)
*B65D 43/02* (2006.01)
*B65D 47/14* (2006.01)

(52) U.S. Cl.
CPC ..... *B65D 85/54* (2013.01); *B65D 43/0225* (2013.01); *B65D 47/141* (2013.01); *B65D 2543/00481* (2013.01)

(58) Field of Classification Search
CPC .... B65D 85/54; B65D 43/0225; B65D 81/20; B65D 81/26; B65D 21/083; B65D 47/14; B65D 47/141; B65D 85/34
USPC ..... 206/527, 802, 822, 242, 384, 811; 99/646 C; 220/4.07, 8, 62.13, 62.11, 737, 220/4.27
See application file for complete search history.

(56) References Cited

U.S. PATENT DOCUMENTS 1,659,399 A * 2/1928 Faber ..... B65D 85/12 220/8
2,416,142 A * 2/1947 Bennett ..... B65D 3/04 138/140
2,707,552 A * 5/1955 Matthiesen ..... B65D 83/0481 220/4.27
4,393,974 A * 7/1983 Levesque ..... A45C 11/00 206/811
5,385,292 A * 1/1995 Labianca ..... B65D 81/26 426/118
5,728,414 A * 3/1998 Terrasi ..... A23G 3/566 426/138
6,116,448 A * 9/2000 Fragos ..... B65D 21/086 220/8
7,866,500 B1 * 1/2011 Peggs ..... B65D 41/04 220/666
9,346,602 B2 * 5/2016 Gitta ..... B65D 81/3211
10,611,521 B1 * 4/2020 Piernot ..... B65D 3/28
11,643,249 B2 * 5/2023 Smith ..... B65D 11/02 220/8

(Continued)

*Primary Examiner* — Rafael A Ortiz
(74) *Attorney, Agent, or Firm* — Michael L. Greenberg, Esq.; Greenberg & Lieberman, LLC

(57) ABSTRACT

A container for storage of a pickle, as well as to facilitate a mess-free eating experience of a pickle is described. The container has a top portion and a bottom portion. Disposed between the top portion and bottom portion, a series of cylindrical segments are present. The cylindrical segments are configured to be removed in sequence in order to reveal more of the pickle as it is consumed, providing the user a means by the which the pickle may be eaten completely without having to directly touch or move the pickle itself. The bottom portion is equipped with a bottom having a means by which the cylindrical segments as well as the top portion may be affixed for storage during consumption of the pickle.

7 Claims, 4 Drawing Sheets

(56) References Cited

U.S. PATENT DOCUMENTS

| | | | | |
|---|---|---|---|---|
| 2007/0012693 | A1* | 1/2007 | Kummer | B65D 43/0231 220/4.27 |
| 2010/0200438 | A1* | 8/2010 | Davies | B65D 81/3205 220/4.27 |
| 2011/0314599 | A1* | 12/2011 | Tuosto | E03C 1/186 4/641 |
| 2016/0257441 | A1* | 9/2016 | Brodwick | B65D 47/06 |
| 2018/0141712 | A1* | 5/2018 | Hendricks | B65D 21/083 |
| 2018/0206614 | A1* | 7/2018 | Lushefski | A45D 33/18 |
| 2018/0370684 | A1* | 12/2018 | Brodwick | B65D 1/0207 |
| 2020/0239188 | A1* | 7/2020 | Curcio | B65D 21/086 |
| 2020/0299026 | A1* | 9/2020 | Gardner | B65D 21/0224 |
| 2022/0119153 | A1* | 4/2022 | Yambao | B65D 41/04 |

* cited by examiner

PICKLE CONTAINER

This application is a non-provisional patent application of provisional patent application No. 63/317,817, filed on Mar. 8, 2022, and priority is claimed thereto.

FIELD OF THE PRESENT INVENTION

The present invention relates to food storage devices, and more specifically relates to a container configured to store at least one pickle such that it may be easily consumed by a user with minimal mess.

BACKGROUND OF THE PRESENT INVENTION

Pickles are a common snack enjoyed by many people all around the world. Dill pickles in particular are sold in a variety of cuts and shapes. The most common "snacking pickle" would be a whole pickle. While they remain a delicious and easy snack, eating a pickle is often quite messy, especially for children.

However, many people wrap the pickle in a paper towel or aluminum foil to try to minimize the sticky mess. While partially effective, this method only works until the paper towel becomes effectively soaked with pickle juices, and the user's hand ends up wet and sticky regardless. Additionally, the user is forced to pull down the paper towel or foil as the pickle is eaten down. Such a method does not leave the user much of an option if he or she wishes to take a break from eating the whole pickle and store it for later. If there were an effective container in which a pickle could both be stored, as well as eaten from in stages, pickle consumption would be easier and less messy.

Thus, there is a need for a new pickle container configured to enable a user to eat a whole pickle in stages via multiple opening points, as well as to store the pickle for later consumption while minimizing the mess common to eating pickles. Such a container is preferably equipped with a series of separations, embodied by nested perpendicular lines, configured to facilitate separation of the container into two or more parts for easy opening of the container at multiple locations along the length of the container.

SUMMARY OF THE PRESENT INVENTION

The present invention is a food storage container configured to contain a whole pickle or a whole pickle in various stages of consumption (i.e. half a pickle, one third of a pickle, three-quarters of a pickle, etc.). The container contains multiple openings, configured to enable the container to separate in multiple locations so that the pickle may be partially eaten while remaining, in part, within the container. Then, the container may be sealed and constrained within the container via the removal of one or more of the sections of the container. The container has a rounded top and a rounded bottom, as well as multiple cylindrical sections disposed between the top and bottom. The junctions between each cylindrical section amount to openings by which the container may be separated, and hence, opened for consumption of the pickle in a mess-free fashion. The top, as well as intervening cylindrical sections, may be affixed to a base of the bottom for storage during consumption as well.

The following brief and detailed descriptions of the drawings are provided to explain possible embodiments of the present invention but are not provided to limit the scope of the present invention as expressed herein this summary section.

BRIEF DESCRIPTION OF THE DRAWINGS

The accompanying drawings, which are incorporated herein and form a part of the specification, illustrate the present invention and, together with the description, further serve to explain the principles of the invention and to enable a person skilled in the pertinent art to make and use the invention.

The present invention will be better understood with reference to the appended drawing sheets, wherein.

DETAILED DESCRIPTION OF THE PREFERRED EMBODIMENT

Figure 1:
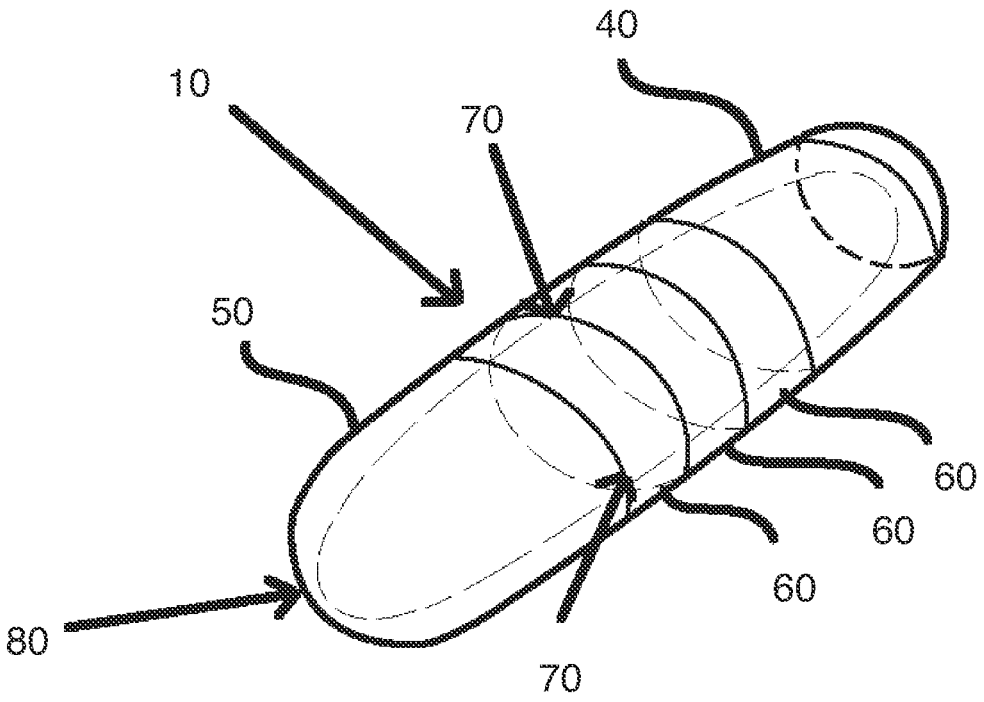
FIG. 1 depicts a view of the primary embodiment of the apparatus of the present invention as seen from the side.
Figure 2:
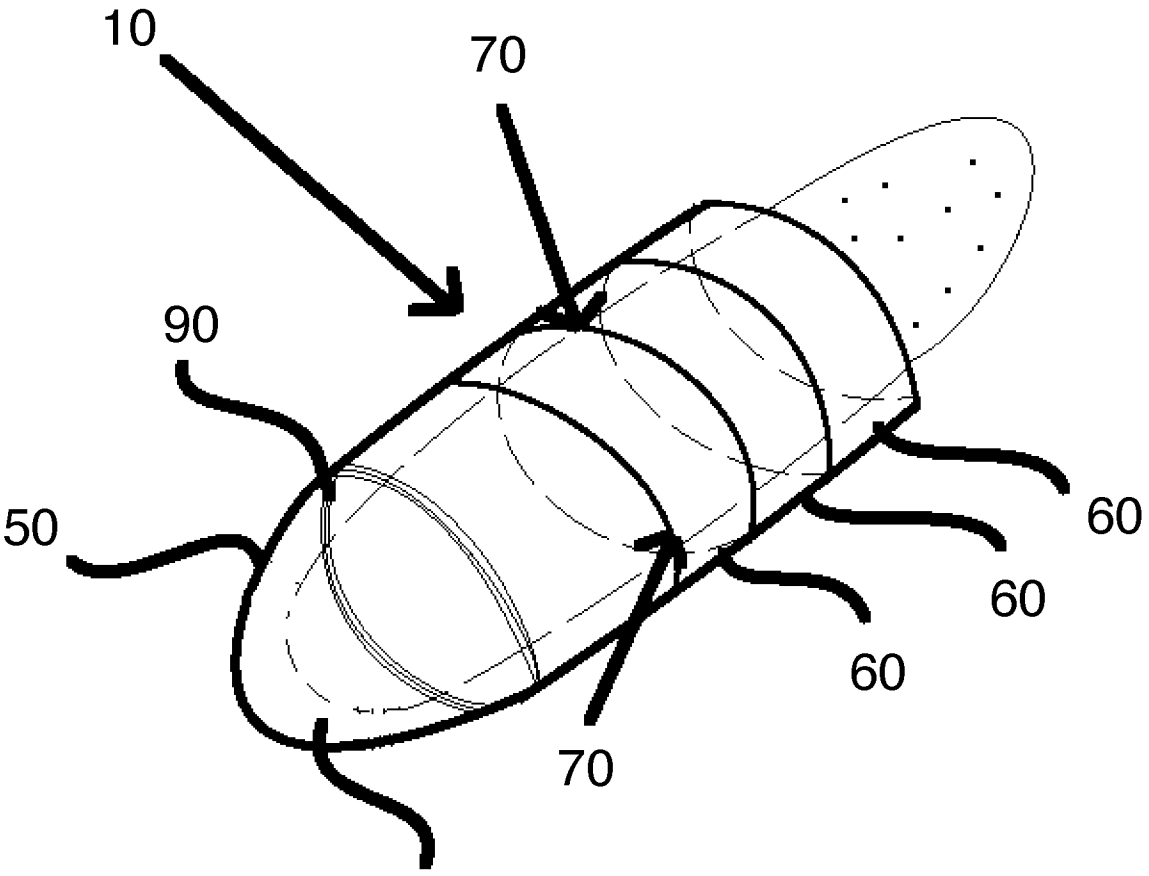
FIG. 2 depicts a view of the primary embodiment of the apparatus of the present invention, depicted in an open position.
Figure 3:
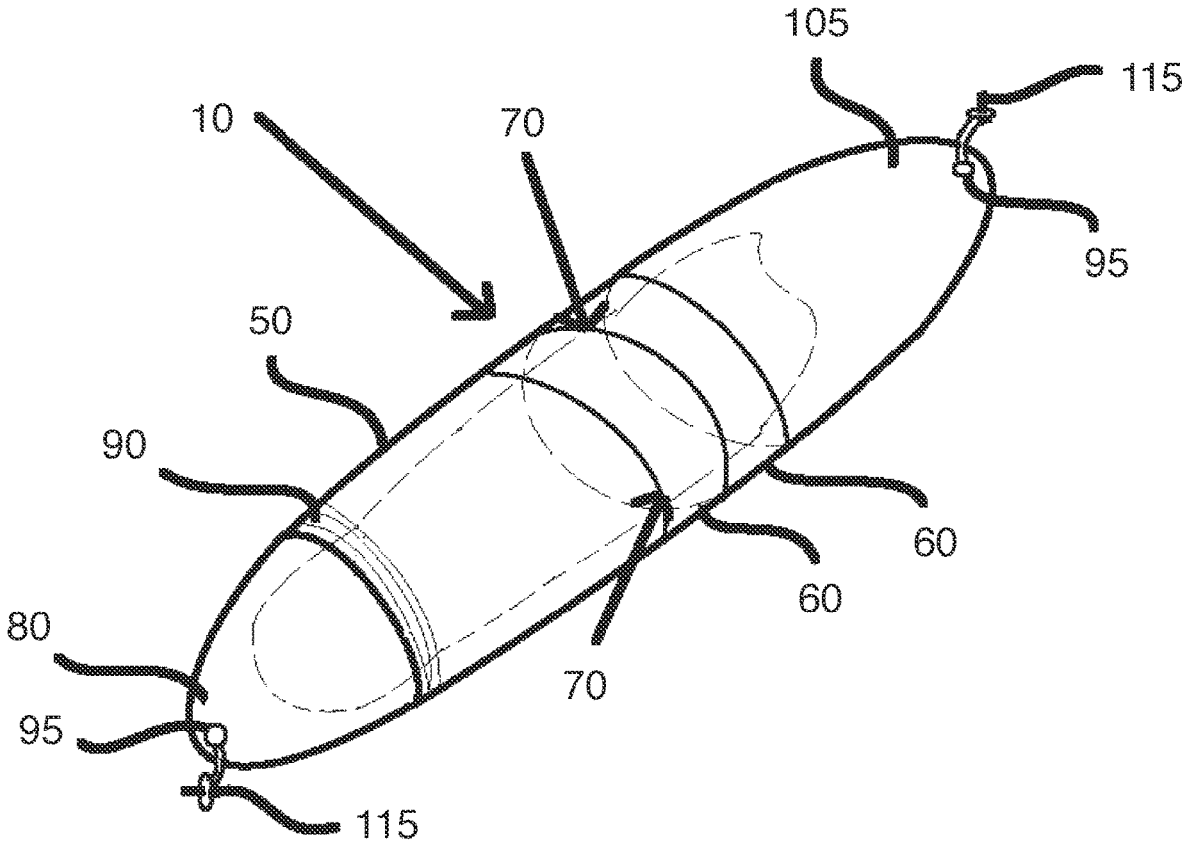
FIG. 3 depicts a view of the primary embodiment of the apparatus of the present invention, shown with the pickle partially eaten, and then container resealed in a shorter form with some cylindrical sections removed.

The present specification discloses one or more embodiments that incorporate the features of the invention. The disclosed embodiment(s) merely exemplify the invention. The scope of the invention is not limited to the disclosed embodiment(s).

References in the specification to "one embodiment," "an embodiment," "an example embodiment," etc., indicate that the embodiment described may include a particular feature, structure, or characteristic, but every embodiment may not necessarily include the particular feature, structure or characteristic. Moreover, such phrases are not necessarily referring to the same embodiment, Further, when a particular feature, structure, or characteristic is described in connection with an embodiment, it is submitted that it is within the knowledge of one skilled in the art to effect such feature, structure, or characteristic in connection with other embodiments whether or not explicitly described.

The present invention is a container configured to house a pickle for storage, as well as for use during consumption by a user. The apparatus of the present invention exhibits a container (10) embodied in a housing having an interior cavity (20) and an exterior (30). The container (10) primarily resembles the general dimensions of a whole dill pickle. The container (10) is equipped with a top section (40) and a bottom section (50). Disposed between the top section (40) and the bottom section (50), cylindrical segments (60) are present. The cylindrical segments (60) are approximately one centimeter in length, and are configured to be added or removed to/from the container (10) in order to modify the overall length of the container (10) to accommodate the entirety of the pickle, as well as to effectively shorten the length of the container (10) as the pickle is eaten while remaining, in part, within the container. There are preferably at least two cylindrical segments (60), however more segments may be present in large embodiments of the present invention. As such, the container (10) is configured to function as a clean handle during the consumption of the pickle by the user.

The cylindrical segments (60) are preferably configured to interlock with one another, with a top of each cylindrical segment (60) mating with a bottom of any other cylindrical segment (60). Similarly, the cylindrical segments (60) are configured to mate with the top section (40) and bottom section (50) of the container in order to form the enclosure of the housing around the pickle. It should be understood that the pickle may be accessed by twisting and pulling at a junction (70) of any two cylindrical segments (60), or at a junction (70) of a cylindrical segment (60) and the top section (40) or bottom section (50) of the apparatus. A bottom (80) of the bottom section (50) is preferably equipped with a means by which the cylindrical segments (60) and/or the top section (40) may be affixed for storage and ease of handling the container (10) when the interior cavity (20) is exposed for consumption of the pickle. This may be accomplished via a friction fitting, threading, peg-based lock, or other similar conventional temporary retaining mechanism. Threading (90) is depicted in FIG. 1, but it should be understood that other conventional attachment mechanisms may be employed to connect the top section (40) to the bottom of the bottom section (50), as well as to facilitate the connection of the cylindrical segments (60) to one another, and/or to the top section (40) and bottom section (50).

Further, in some embodiments of the present invention, at least one juice hole (95) is preferably present at a rounded point (105) or "tip" of the bottom section (50) and/or top section (40) to facilitate the drainage of pickle juice. Pickle juice may be saved within the container (10) for enjoyment later. As such, the user may opt to suck the pickle juice out of the at least one juice hole (95). Each juice hole (95) is preferably equipped with a removable plug (115) (a juice hole plug) which is preferably composed of a silicone or plastic material to provide a water-tight seal.

Figure 4:
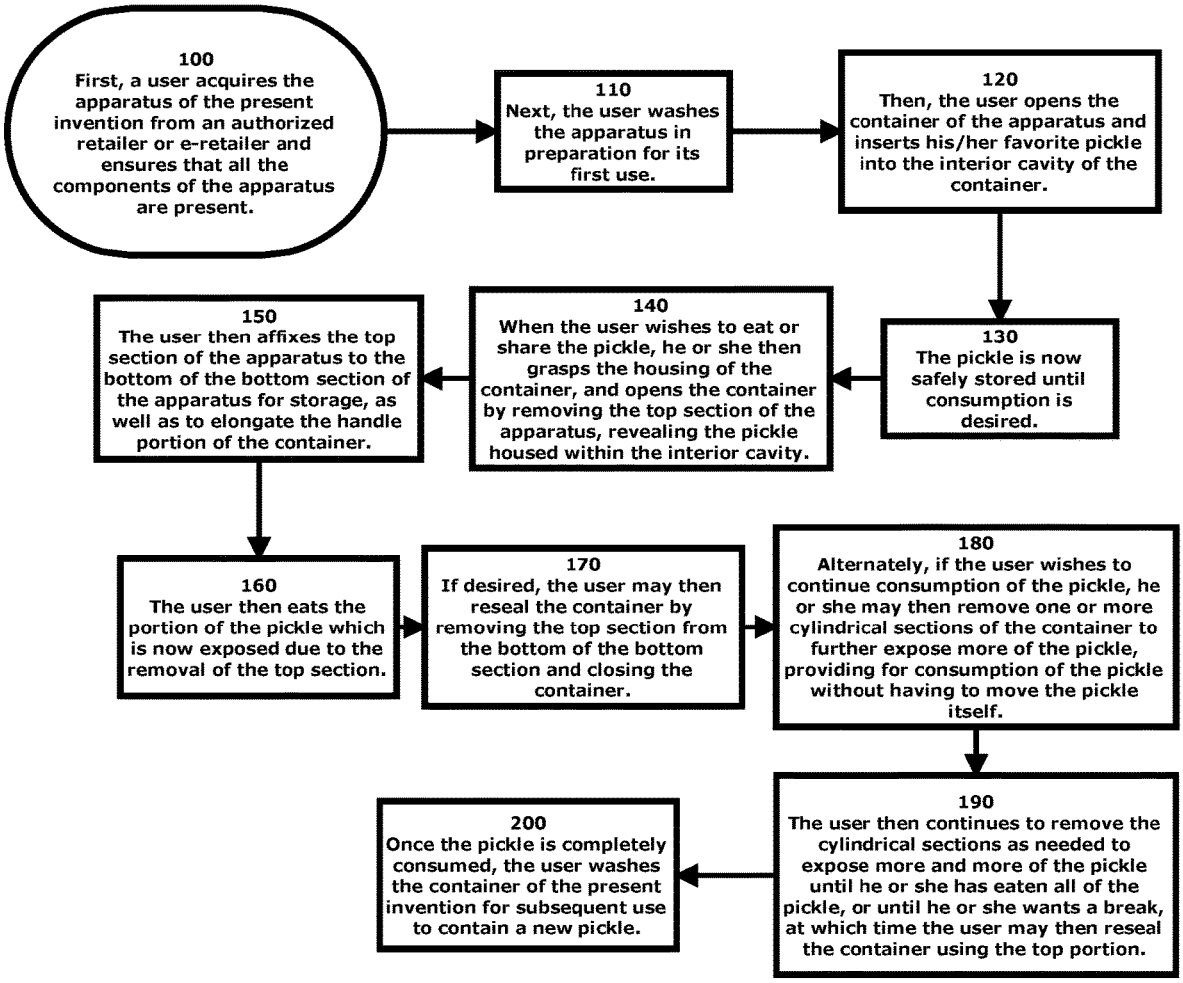
FIG. 4 depicts a flow chart detailing the process of use of the apparatus of the present invention.

The process of use of the apparatus of the present invention, as shown in FIG. 4, is preferably as follows:

1. First, a user acquires the apparatus of the present invention from an authorized retailer or e-retailer and ensures that all the components of the apparatus are present. (100)
2. Next, the user washes the apparatus in preparation for its first use. (110)
3. Then, the user opens the container of the apparatus and inserts his/her favorite pickle into the interior cavity of the container. (120)
4. The pickle is now safely stored until consumption is desired. (130)
5. When the user wishes to eat or share the pickle, he or she then grasps the housing of the container, and opens the container by removing the top section of the apparatus, revealing the pickle housed within the interior cavity. (140)
6. The user then affixes the top section of the apparatus to the bottom of the bottom section of the apparatus for storage, as well as to elongate the handle portion of the container. (150)
7. The user then eats the portion of the pickle which is now exposed due to the removal of the top section. (160)
8. If desired, the user may then reseal the container by removing the top section from the bottom of the bottom section and closing the container. (170)
9. Alternately, if the user wishes to continue consumption of the pickle, he or she may then remove one or more cylindrical sections of the container to further expose more of the pickle, providing for consumption of the pickle without having to move the pickle itself. (180)
10. The user then continues to remove the cylindrical sections as needed to expose more and more of the pickle until he or she has eaten all of the pickle, or until he or she wants a break, at which time the user may then reseal the container using the top portion. (190). It should be noted that the top portion is configured to attach to any cylindrical section equally, or may even be attached directly to the bottom portion if applicable (such as when the pickle becomes very small as the majority has been eaten).
11. Once the pickle is completely consumed, the user washes the container of the present invention for subsequent use to contain a new pickle. (200)

It should be noted that the present invention is preferably available for purchase in two different colors: smokey white and dark green. However, it is envisioned alternate colors may be made available in future alternate embodiments of the present invention. Further, the smokey color is preferably smooth, whereas the dark green is preferably textured with bumps, similar to the actual cosmetics of a pickle. Three sizes of the container (10) are preferably available: a small, a medium, and a large. For medium and larger embodiments of the present invention, only dark green may be available. The container (10) is preferably composed of a durable, food-safe plastic which is non-breakable, lightweight, and easy to use. It is envisioned that each size may be sold in bundles, individually, or in mixed packs.

Further, it should be understood that the container (10) of the present invention is inherently shaped like an actual pickle, with the top section (40) being narrow at the top, the bottom section (50) being narrow at the bottom, and the cylindrical segments (60) being wider than the top section (40) and the bottom section (50). There is tapering to the edges at junctions (70) to facilitate their connections where applicable.

Having illustrated the present invention, it should be understood that various adjustments and versions might be implemented without venturing away from the essence of the present invention. Further, it should be understood that the present invention is not solely limited to the invention as described in the embodiments above, but further comprises any and all embodiments within the scope of this application.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The exemplary embodiment was chosen and described in order to best explain the principles of the present invention and its practical application, to thereby enable others skilled in the art to best utilize the present invention and various embodiments with various modifications as are suited to the particular use contemplated.

I claim:

1. A pickle container comprising:

a body, said body composed of discrete interlocking segments;

wherein said body is generally cylindrical;

wherein said interlocking segments are cylindrical;

a top section, said top segment terminating at a rounded point;

wherein said top section is configured to interlock with any of said interlocking segments;

wherein said interlocking segments are shorter than said top section;

a bottom section, said bottom section terminating at a rounded point; and wherein said interlocking segments are shorter than said bottom section;

wherein said interlocking segments are equal in size;

wherein said top section differs in size from said bottom section;

and wherein said top section and said bottom section comprise a top and a bottom of the container respectively;

at least one juice hole, said at least one juice hole present at said rounded point of each said bottom section and top section; and a juice hole plug, said juice hole plug removably disposed within said at least one juice hole of each of said bottom section and said top section, wherein said juice hole plug is configured to sealingly engage said at least one juice hole to prevent liquid from exiting the container when engaged, and to permit selective removal of liquid when disengaged.

2. The apparatus of claim 1, wherein the container is available in three sizes: a first size, a second size which is bigger than said first size, and a third size which is bigger than said first size and said second size.

3. The apparatus of claim 1, wherein said cylindrical segments are wider in diameter than said rounded point of said top section and said rounded point of said bottom section.

4. The apparatus of claim 1, wherein said juice hole plug forms a liquid-tight seal with said at least one juice hole.

5. A pickle container comprising:

a body, said body composed of discrete interlocking segments;

wherein said body is generally cylindrical;

wherein said interlocking segments are cylindrical;

a top section, said top segment terminating at a rounded point;

wherein said top section is configured to interlock with any of said interlocking segments; wherein said interlocking segments are shorter than said top section;

a bottom section, said bottom section terminating at a rounded point; wherein said interlocking segments are shorter than said bottom section;

wherein said interlocking segments are equal in size;

wherein said top section differs in size from said bottom section;

wherein said top section and said bottom section comprise a top and a bottom of the container respectively;

junctions, said junctions present between said interlocking segments;

wherein said junctions are formed by threads present on a first side and a second side of each interlocking segment;

at least one juice hole, said at least one juice hole present at said rounded point of each said bottom section and said top section; and a juice hole plug, said juice hole plug removably disposed within said at least one juice hole of each of said bottom section and said top section, wherein said juice hole plug is configured to sealingly engage said at least one juice hole to prevent liquid from exiting the container when engaged, and to permit selective removal of liquid when disengaged;

wherein said top section and said bottom section are equipped with interlocking threads, said interlocking threads configured to interface with said interlocking segments; and wherein said cylindrical segments are wider in diameter than said rounded point of said top section and said rounded point of said bottom section.

6. The apparatus of claim 5, wherein the container is available in three sizes: a first size, a second size which is bigger than said first size, and a third size which is bigger than said first size and said second size.

7. The apparatus of claim 5, wherein said juice hole plug forms a liquid-tight seal with said at least one juice hole.

* * * * *